US005402035A

United States Patent [19]

Lee

[11] Patent Number: 5,402,035

[45] Date of Patent: Mar. 28, 1995

[54] CATHODE STRUCTURE FOR AN ELECTRON TUBE

[75] Inventor: Gyeong S. Lee, Kumi, Rep. of Korea

[73] Assignee: Goldstar Co., Ltd., Seoul, Rep. of Korea

[21] Appl. No.: 949,138

[22] Filed: Sep. 23, 1992

[51] Int. Cl.[6] ..... H01J 1/02; H01J 29/04

[52] U.S. Cl. ..... 313/456; 313/270; 313/37

[58] Field of Search ..... 313/451, 456, 337, 270, 313/37, 38

[56] References Cited

U.S. PATENT DOCUMENTS 3,128,407 4/1964 Mattson ..... 313/270 X 3,881,124 4/1975 Buescher et al. ..... 313/37

*Primary Examiner*—Sandra L. O'Shea

[57] ABSTRACT

An electron tube includes a cathode structure which has a hollow cylindrical sleeve having a heater mounted within the sleeve. There is a cathode cap disposed at the top of the sleeve to contain an electron emission material. A hollow cylindrical cathode holder is used for supporting the sleeve. A unitary support interconnects the sleeve and the holder and has formed in its outer peripheral wall a plurality of circumferentially spaced through holes for preventing deformation of the support.

11 Claims, 2 Drawing Sheets

CATHODE STRUCTURE FOR AN ELECTRON TUBE

BACKGROUND OF THE INVENTION

1. Field of the Invention

This invention relates to a cathode structure for an electron tube. In particular the invention is directed to a cathode body fixing structure for a high current density type electron tube. The fixing structure prevents deformation of the cathode body for the electron tube caused by heat generated by a heater, or burnout of the heater caused by electric field concentration.

2. Description of the Prior Art

Recently, electron tubes have been made to have a large size and a higher brightness than previously. To this end, there have been actively made the studies cathodes for high current density type electron tubes. Generally, as illustrated in FIGS. 1 and 2, a cathode body comprises a cathode cap 16 having an electron emission material 17 which includes high temperature, heat resisting metal powder such as tungsten(W) and an oxide such as BaO, CaO, or $Al_2O_3$, and a hollow sleeve 11 made of high temperature, heat resisting metal powder such as molybdenum (Mo). There is also a heater 15 mounted within the sleeve 11. The cathodes for the high current density electron tubes require cathode current density of about 10 A/cm$^2$, and there it is required to obtain such current density at an operating temperature of about 1000° C.b (brightness temperature). In particular, since a very higher activating temperature, of about 1200° C.b is required, the cathodes have exhibited certain disadvantages in that the higher activation temperature results in increased power consumption of the heater, structural deformation of cathode body and burnout of the heater.

With a view to overcoming this problem, there has been proposed a cathode body fixing structure as shown in FIGS. 1 and 2, which comprises a plurality of spaced-apart metallic fixing pieces or metallic ribbons 13 interconnecting the outer peripheral surface of the lower end of the sleeve 11 and the top of a cathode holder 12. With this construction, when a rated voltage is applied to the heater 15 of the cathode body, the temperature of the heat generation section of the heater is raised to a given temperature, and thus the heat is transferred to the electron emission material 17 in the cathode cap 16, so that thermions of predetermined density are emitted from the surface of the electron emissions material. At this time, since the heater 15 rapidly expands because of heat toward the electron emission material 17 located at the top of the cathode body, the sleeve 11 of the cathode body also expands toward the material 17 because of heat transferred to it. As a result, the metallic fixing pieces 13 connecting the cathode body to the cathode holder 12 to support the cathode body undergo deformation because of the heat transferred to them. The reason for this is that the speed of the thermal expansion of the heater 15 is much greater than that of the sleeve 11 and the metallic fixing pieces 13.

In the prior art cathode body fixing structure, since a plurality of the metallic fixing pieces 13 between the sleeve 11 and the cathode holder 12 are disposed in laterally spaced relation to each other, the heat transferred from the heater 15 to the sleeve is not readily conducted to the cathode holder, but is effectively conducted to the electron emission material 17 generating thermions. Therefore, the efficiency of the heater is increased, and this somewhat contributes to reduction in power consumption of the heater.

This prior cathode body fixing structure however has a drawback in that since the metallic fixing pieces 13 interconnecting the sleeve and the cathode holder are inherently weak, as the temperature of the cathode body is raised to a high temperature depending upon heat generated by the heater, the fixing pieces coupled to the sleeve are apt to be easily deformed because of thermal expansion of the sleeve from the heat transferred by the heater.

Further, since the joined portions of the lower ends of the fixing pieces and the lower end of the sleeve are discrete, to form portruded portions on the outer periphery of the sleeve, electric fields may be concentrated at the protruded portions to cause electric discharge between the sleeve and the heater. This structure results in a burnout of the heater.

SUMMARY OF THE INVENTION

In view of the aforesaid problems of the prior art, it is an object of the present invention to improve the structure for fixing a cathode body to a cathode holder, thereby preventing thermal deformation of the cathode body at a higher cathode temperature and burnout of a heater due to electric field concentration during operation of the heater.

To achieve the above object, there is provided according to one embodiment of the present invention a cathode structure for an electron tube comprising a hollow, cylindrical sleeve having a heater mounted therein and a cathode cap disposed at its which contains an electron emission material. There is a hollow, cylindrical cathode holder for supporting the sleeve; and a unitary support interconnecting the sleeve and the cathode holder. The cathode holder has formed in its peripheral wall a plurality of circumferentially spaced through-holes, the outer limits of which are a solid portion of the cathode holder, for preventing thermal deformation thereof.

DESCRIPTION OF THE PREFERRED EMBODIMENT

Figure 1:
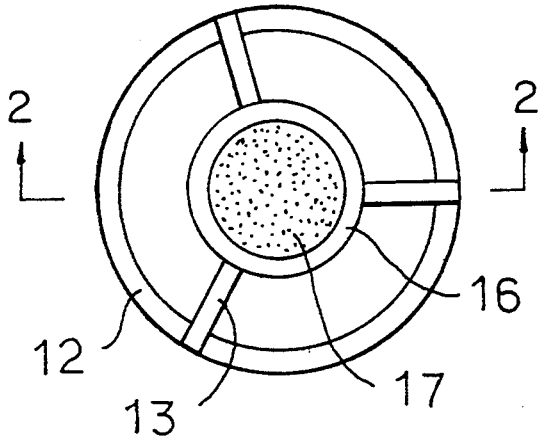
F I G. 1 PRIOR ART
FIG. 1 is a plan view of a cathode body fixing structure for an electron tube according to the prior art.
Figure 2:
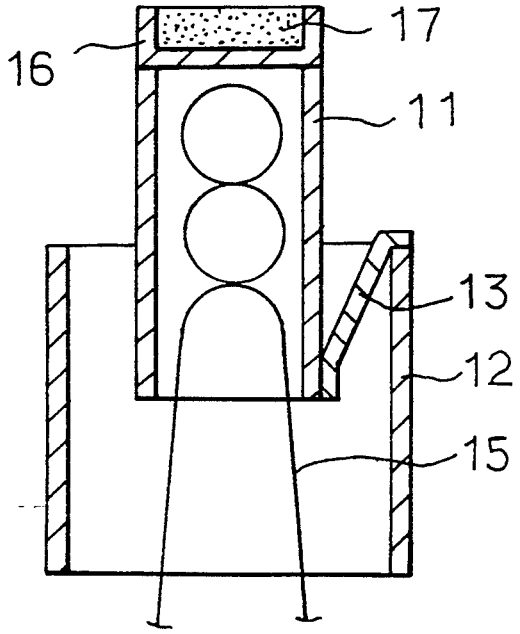
F I G. 2 PRIOR ART
FIG. 2 is a cross-sectional view taken along line 2—2 of FIG. 1.
Figure 3:
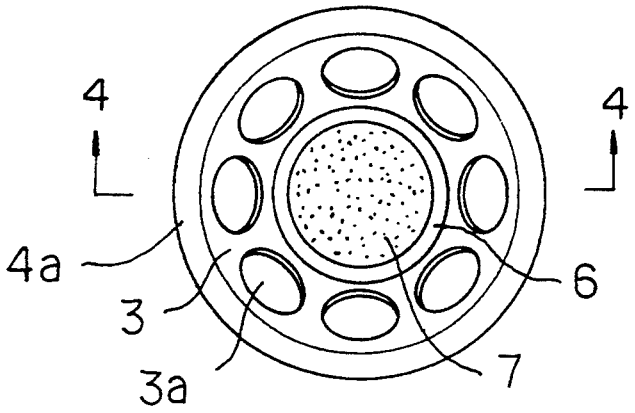
FIG. 3 is a plan view of a cathode body fixing structure for an electron tube according to the present invention.
Figure 4:
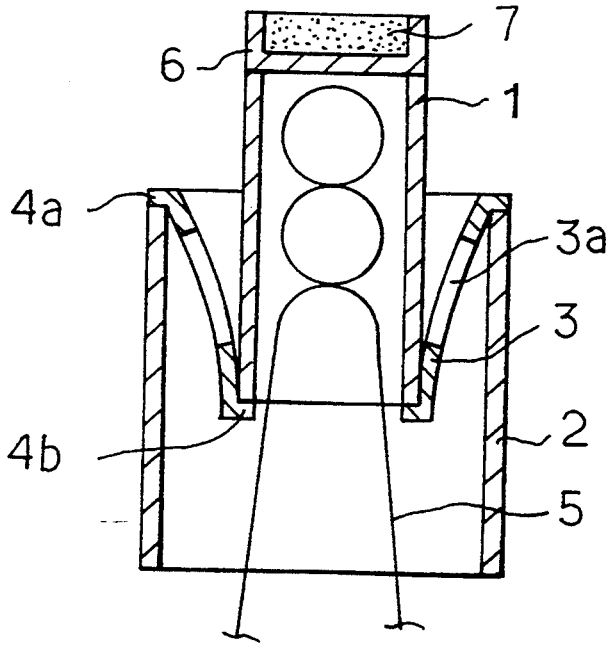
FIG. 4 is a cross-sectional view taken along line 4—4 of FIG. 3.

The invention will now be described in detail, by way of example, with reference to FIGS. 3 and 4 of the accompanying drawings, in which FIG. 3 is a plan view of the cathode body fixing structure according to the present invention and FIG. 4 is a cross-sectional view taken along line 4—4 of FIG. 3.

The basic construction of the cathode structure according to the present invention is the same as that of the prior art as described above with the exception of means for fixing a sleeve 1 of a cathode body to a cathode holder 2. According to the present invention, as shown in FIGS. 3 and 4, a unitary, trumpet-shaped support 3 having a plurality of circumferentially spaced through-holes 3*a* formed in its peripheral wall for preventing thermal deformation thereof is used, instead of a plurality of metallic fixing pieces as in the prior art, to interconnect the sleeve 1 and the cathode holder 2. Reference numeral 6 denotes a cathode cap containing an electron emission material 7.

More specifically, the unitary, trumpet-shaped support 3 is disposed between the hollow, cylindrical cathode holder 2 and the hollow, cylindrical sleeve 1 concentrically put in part into the holder, and fixed at one end to the outer periphery of the lower end of the sleeve and at the other end to the top of the cathode holder. The through-holes 3*a* formed in the peripheral wall of the support 3 act to radiate heat generated by a heater 5 and transferred to the support during operation of the heater. Each of the through-holes may be of either circular or oblong shape.

According to the preferred embodiment of the present invention, as shown in FIG. 4, the unitary support 3 may be fixed at its both ends to the sleeve 1 and the cathode holder 2 by means of separate, annular securing rings 4*a* and 4*b*.

Alternatively, the support 3 may have cylindrical turnover portions formed at its opposite end openings to be attached to the outer peripheral surface of the sleeve 1 and the inner peripheral surface of the holder 2, respectively.

Besides, various modified constructions may be employed to fix the unitary, trumpet-shaped support 3 to the sleeve 1 and the cathode holder 2.

In the cathode structure according to the present invention, since the sleeve 1 is connected to the cathode holder 2 through the trumpet-shaped support 3 fixed to them by means of the securing rings 4, as shown in FIG. 4, and the support has the through-holes 3*a* formed in its peripheral wall, although during operation of the heater 5 the heat of a high temperature generated by the heater is conducted to the support 3 through-holes 3*a* of the support. In this manner, since the heat conducted to the support can be effectively dissipated through the through-holes 3*a*, so that thermal deformation of the cathode body can be greatly reduced.

Further, since the support 3 is attached at both ends to the sleeve 1 and the cathode holder 2 by means of either the annular securing rings 4 or the cylindrical turnover portions formed at the opposite end openings of the support to be attached to the peripheral surfaces of the sleeve and the holder, circumferentially continuous joints are obtained at the opposite ends of the support without forming any protruded portion on the periphery of the sleeve, so that the electric field concentration does not occur during operation of the heater. As a result,electric field concentration may be prevented, whereby burnout of the heater due to the electric discharge may be reduced.

While the invention has been shown and described with particular reference to preferred embodiments thereof, it will be understood that variations and modifications in detail may be made therein without departing from the spirit and scope of the invention as defined in the appended claims.

What is claimed is:

1. A cathode structure for an electron tube comprising:

a hollow, cylindrical sleeve having a heater mounted therein and a cathode cap disposed at its top to contain an electron emission material;

a hollow, cylindrical cathode holder for supporting said sleeve; and a unitary support interconnecting said sleeve and said cathode holder and having formed in its peripheral wall a plurality of circumstantially spaced through-holes for preventing thermal deformation thereof the holes having an outer limit defined by a solid portion of the support.

2. A cathode structure for an electron tube as claimed in claim 1, wherein said support is of a trumpet shape.

3. A cathode structure for an electron tube as claimed in claim 1, wherein said support is fixed at the upper and lower ends thereof to the upper end of said cathode holder and the lower end of said sleeve by means of annular securing rings.

4. A cathode structure for an electron tube as claimed in claim 1, wherein each of said through-holes is of circular or oblong shape.

5. A cathode structure for an electron tube as claimed in claim 1, wherein there is a means forming a continuous joint for interconnecting the sleeve and the cathode holder, so that electrical field concentration is prevented and heater burnout due to electrical discharge is reduced.

6. A cathode structure for an electron tube as claimed in claim 5, wherein said means are turnover portions formed at opposite ends of the unitary support attached to peripheral surfaces of the sleeve and holder respectively.

7. A cathode structure for an electron tube as claimed in claim 5, wherein the means are annular securing rings attached at both ends of the support and to the holder and sleeve respectively.

8. A cathode structure for an electron tube comprising:

a hollow, cylindrical sleeve having a heater mounted therein and a cathode cap disposed at its top to contain an electron emission material;

a hollow, cylindrical cathode holder for supporting said sleeve; and a unitary support interconnecting said sleeve and said cathode holder and having formed in its peripheral wall a plurality of circumstantially spaced through-holes for preventing thermal deformation thereof the holes having an outer limit defined by a solid portion of the support; and the holes being completely surrounded by an inner wall of the cathode holder, so that electrical leakage is prevented between the heater and the emission material.

9. A cathode structure for an electron tube as claimed in claim 8, wherein there is a means forming a continuous joint for interconnecting the sleeve and the cathode holder, so that electrical field concentration is prevented and heater burnout due to electrical discharge is reduced.

10. A cathode structure for an electron tube as claimed in claim 9, wherein said means are turnover portions formed at opposite ends of the unitary support attached to peripheral surfaces of the sleeve and holder respectively.

11. A cathode structure for an election tube as claimed in claim 9, wherein the means are annular securing rings attached at both ends of the support and to the holder and sleeve respectively.

* * * * *